US005241239A

United States Patent [19]

Rao

[11] Patent Number: 5,241,239

[45] Date of Patent: Aug. 31, 1993

[54] TUBULAR ELECTRIC LAMP HAVING A LAMP BASE SLEEVE WITH AN ACCESS PORT FOR SECURING A CONTACT TO A CURRENT-CONDUCTOR

[75] Inventor: Ragnunatha S. Rao, Lexington, Ky.

[73] Assignee: North American Philips Corporation, New York, N.Y.

[21] Appl. No.: 810,752

[22] Filed: Dec. 18, 1991

[51] Int. Cl.[5] ..... H01J 105/50

[52] U.S. Cl. ..... 313/318; 313/331; 313/623; 313/624; 313/580

[58] Field of Search ..... 313/318, 331, 332, 333, 313/624, 625, 623, 580, 579; 403/DIG. 7

[56] References Cited

U.S. PATENT DOCUMENTS

| | | | |
|---|---|---|---|
| 3,001,096 | 9/1961 | Mosbey | 313/318 |
| 3,001,097 | 9/1961 | Smialek | 313/318 |
| 4,069,437 | 1/1978 | Noteltiers et al. | 313/318 |
| 4,404,491 | 9/1983 | Siaens et al. | 313/318 |
| 4,714,858 | 12/1987 | Sanders | 313/318 |
| 4,751,422 | 6/1988 | Morianz et al. | 313/318 |
| 5,001,388 | 3/1991 | Janssen et al. | 313/318 |

FOREIGN PATENT DOCUMENTS 1053822 1/1967 United Kingdom .

*Primary Examiner*—Donald J. Yusko
*Assistant Examiner*—Ashok Patel
*Attorney, Agent, or Firm*—Brian J. Wieghaus

[57] ABSTRACT

A tubular electric lamp has lamp bases each consisting of an electrically insulative sleeve and conductive contact mounted therein. The sleeve has a first abutment which buts against the seal, a second abutment against which the conductive contact is seated, and an access port located axially between the first and second abutments. With the contact seated against the second abutment and the sleeve mounted over the current conductor and butted against the seal, the current conductor and a projection of the conductive contact extend axially past the access port. The conductive contact is welded and/or crimped to the conductive contact through the access port with the contact seated against the second abutment and the first abutment butted against the seal, fixing the sleeve between the contact and the seal.

12 Claims, 2 Drawing Sheets

TUBULAR ELECTRIC LAMP HAVING A LAMP BASE SLEEVE WITH AN ACCESS PORT FOR SECURING A CONTACT TO A CURRENT-CONDUCTOR

BACKGROUND OF THE INVENTION

The invention relates to electric lamps comprising a tubular lamp vessel sealed in a vacuum-tight manner and having respective seals at opposite ends thereof, an electric element disposed in said lamp vessel, first and second current-supply conductors extending axially from said electric element through said seals to the exterior of said lamp vessel, and a lamp base disposed on each seal comprised of a conductive contact connected to the respective current-supply conductor and an electrically insulative sleeve in which said contact is mounted.

Lamps of this type are known from U.S. Pat. No. 3,001,096 (Moseby) and U.S. Pat. No. 4,404,491 (Siaens et al). The lamp bases carried by the opposing seals are of the R7 type and cooperate with spaced sockets to support the lamp in a fixture. The conductive contacts have an outer face of concave spherical contour which mate with opposed rounded probe-like terminals of the spaced sockets. When used in a fixture with a reflector, the socket terminals cooperate with the contacts to align the electric element of the lamp with the focus of the reflector. The contacts are recessed in the insulative sleeve to prevent persons from touching the contacts when the lamp is secured in electrically live sockets.

In the known lamps, the conductive contacts are first aligned with and welded to the respective current-supply conductor. The insulative sleeve is then mounted over the conductor and secured to the seal by basing cement or by a metal spring connected to the conductive contact. The application and curing of cement is time consuming and hence expensive, and also of low mechanical strength. The use of a metallic spring is also unfavorable because it increases the number of lamp parts and increases lamp cost.

It is the object of the invention to provide a lamp of the type described in the opening paragraph in which the sleeve and conductive contact are secured in a more cost effective and reliable manner.

SUMMARY OF THE INVENTION

According to the invention, this object is achieved in that said contact includes a cap and a projection extending therefrom, said sleeve includes a first abutment for butting against said pinch seal, a second abutment for seating said contact cap, and an access port axially located between said first and second abutments, said first and second abutments are arranged such that, with said sleeve mounted over said current-supply conductor with said first abutment against said seal and said contact cap seated against said second abutment, said current-supply conductor and said contact projection extend adjacent each other past said access port, and said contact projection is fixed to said current-supply conductor at the axial position of said access port with said contact cap biasably seated against said second abutment and said first abutment biasably seated against said pinch seal, securing said contact against said sleeve and said sleeve against said pinch seal.

In the lamp according to the invention, the base is assembled in reverse order to that of the known lamps. The insulative sleeve is first mounted over the current-supply conductor against the seal and then the contact is inserted into the sleeve. When the conductive contact is fixed to the respective current-supply conductor through the access port, for example by welding or crimping, the sleeve becomes fixed by reason of being held between the seal and the contact cap. Consequently, the use of cement or springs to join the sleeve to the contact and/or the seal are avoided.

According to a favorable embodiment, the access port is comprised of two oppositely disposed and aligned access bores through which crimping and/or welding probes may be inserted to join the current conductor to the contact projection. In another favorable embodiment, the contact projection is tubular and has an axial bore into which the current-supply conductor extends. This facilitates assembly and alignment of the contact with the current-supply conductor.

According to another embodiment, the sleeve includes a pair of diametrical slots which snugly receive the pinch seal and whose ends comprise the first sleeve abutment. The second sleeve abutment is comprised of an internal circumferential shoulder against which the contact cap seats.

According to yet another favorable embodiment, the seals are pinch seals which include a pair of axially extending flanges at opposite lateral sides thereof. The sleeve snugly fits transversely between the flanges to transversely support the sleeve on said seal.

The electric element may be a filament or an electrode pair. As used herein, the term "welding" refers to a localized coalescence of metal wherein coalescence is produced by heating to suitable temperatures with or without the application of pressure, and with or without the use of filler material. The filler material may have a melting point similar to the base metals, or lower than the base metals. This definition includes resistance welding, soldering, brazing and braze-welding, among others.

BRIEF DESCRIPTION OF THE DRAWINGS

An embodiment of the lamp according to the invention will now be described in greater detail with reference to the accompanying drawing.

DESCRIPTION OF THE PREFERRED EMBODIMENT

Figure 1:
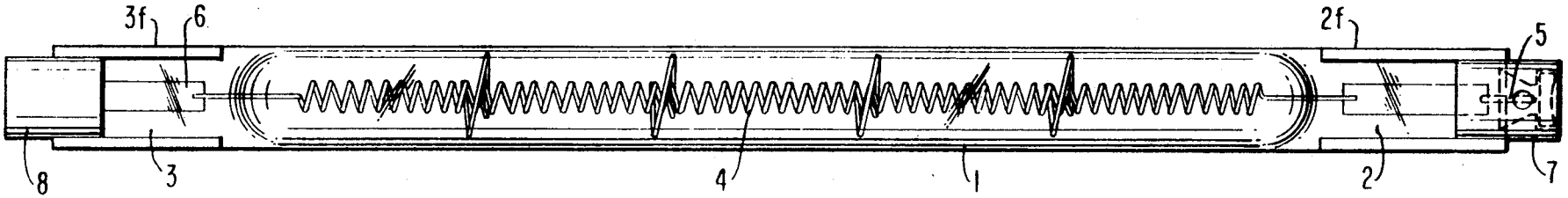
FIG. 1 shows a lamp in side elevation.

The electric lamp of FIG. 1 has a tubular light transmissive lamp vessel 1 which is sealed in a vacuum-type manner by pinch seals 2, 3 at its opposing ends. Each seal includes a pair of axially extending flanges 2*f*, 3*f* at opposite lateral sides thereof. The lamp vessel 1 accommodates a filament as an electric element 4. Current-supply conductors 5, 6 extend from the filament 4 axially through the seals 2, 3 respectively, to the exterior.

Lamp bases 7, 8 are secured on seals 2, 3 between the flanges.

Figure 3:
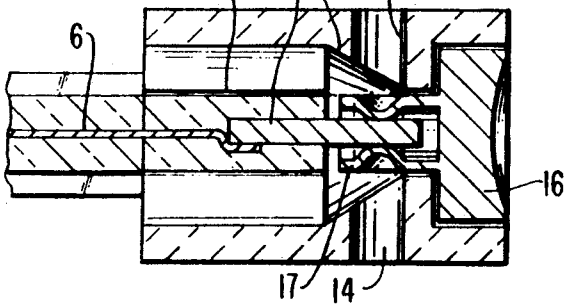
FIG. 3 shows the lamp base of FIG. 2 in an elevation taken on the line III—III in FIG. 2.
Figure 2:
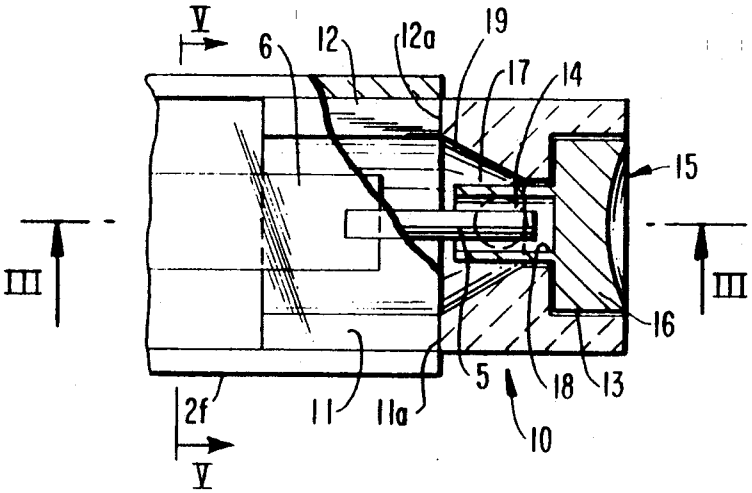
FIG. 2 shows a cross-section of the lamp base of FIG. 1 on a larger scale and as assembled on the seal.
Figure 4:
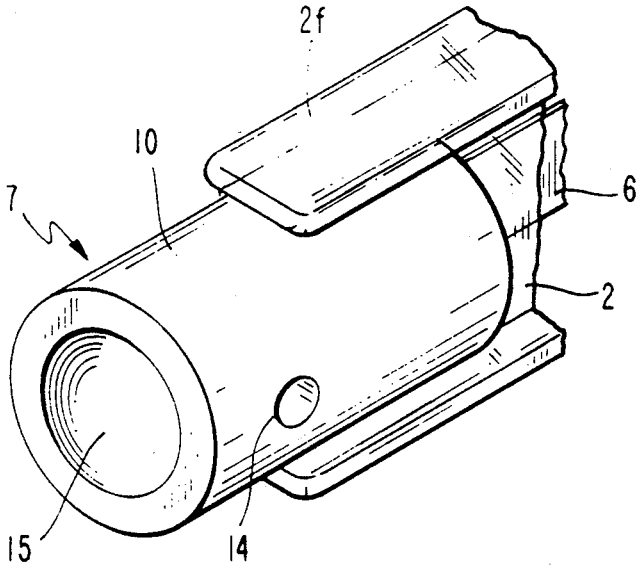
FIG. 4 is a perspective view of the lamp base mounted the pinch seal.
Figure 5:
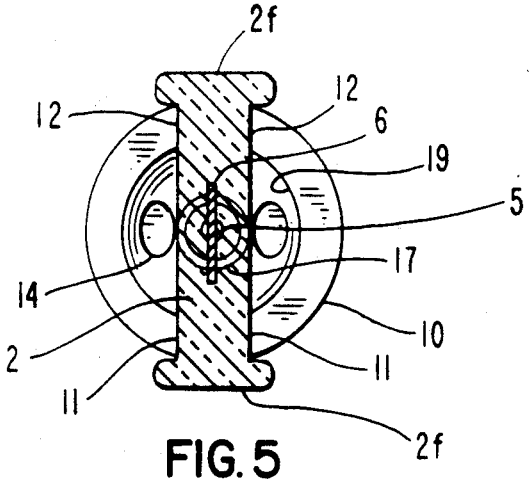
FIG. 5 is a cross-section of the lamp taken on the line V—V in FIG. 2.

With reference to FIGS. 2, 3, each base is comprised of an electrically insulative ceramic sleeve 10 and a conductive contact 15. The sleeve has a pair of diametrical slots 11, 12 which fit snugly over the end portion of the pinch seal. The sleeve also fits snugly between the flanges 2*f*, 3*f* of the seal to transversely support the sleeve. The ends 11*a*, 12*a* of the slots comprise a first abutment of the sleeve which buts against the end of the respective seal 2. The sleeve has a second abutment 13, in the form of an internal circumferential shoulder, against which a cap 16 of the contact 15 is seated. An access port in the form of opposing transverse bores 14 is axially located between the first abutment 11*a*, 12*a* and the second abutment 13. The transverse bores 14 extend into a conical internal cavity 19 of the sleeve 10. The contact 15 further includes a tubular projection 17 which encloses axial bore 18 and is mountable over the current-supply conductor 5. With the sleeve 10 mounted over conductor 5 and butted against the pinch seal and with the contact head 16 seated against the second abutment 13, the conductor 5 extends axially past the access bores 14 into the axial bore 18 of projection 17.

The clearance between the projection 17 and conductor 5 in the Figures is exaggerated for clarity. FIG. 2 shows the contact projection mounted over the conductor 5 before crimping/welding and FIG. 3 shows the projection crimped and welded. The wall thickness of projection 17 and its clearance with conductor 5 are selected to permit crimping of the projection onto the current conductor while allowing ease of mounting onto the conductor. By way of example, the contact 15 shown in FIGS. 2, 3, was nickel and the projection 17 had a wall thickness of 2.3 mm and an inside diameter of 0.9 mm. The conductor 5 was a conventional molybdenum wire having a diameter of 0.76 mm. The contact 15 is simultaneously crimped and resistance welded to the conductor 5 by welding electrodes through bores 14. However, the contact may crimped by a first set of probes and then welded by different probes. Additionally, the contact may be solely crimped or welded to the conductor 5.

Those of ordinary skill in the art will appreciate that various modifications may be made to the lamp base without departing from the spirit and scope of the appended claims. For example, instead of being tubular, the projection 17 may consist of one, or a pair of spaced, tabs which extend over the conductor 5 transverse to the access bores 14. The insulative sleeve need not be a ceramic but may be formed, for example, from high temperature plastics such as thermohardening synthetic resins such as silicone resins or thermoplastic resins such as polyimides.

What is claimed is:

1. An electric lamp comprising a lamp vessel sealed in a vacuum-tight manner and having respective pinch seals at opposite ends thereof, an electric element disposed in said lamp vessel, first and second current-supply conductors each extending axially from said electric element through a respective said pinch seal to the exterior of said lamp vessel, and a lamp base disposed on each pinch seal, each lamp base including a conductive contact connected to a respective current-supply conductor and an electrically insulative sleeve in which said conductive contact is mounted, said insulative sleeve having a sleeve wall extending around said respective current-supply conductor and conductive contact, characterized in that:

said conductive contacts each include a cap and a projection extending therefrom, said insulative sleeves each include a first abutment butting against a respective said pinch seal, a second abutment for seating a said contact cap, and an access port extending through said sleeve wall and axially located between said first and second abutments, said first and second abutments are arranged on each sleeve such that, with said sleeve mounted over said current-supply conductor with said first abutment butting against said pinch seal and said contact cap seated against said second abutment, said current-supply conductor and said contact projection extend adjacent each other past said access port, and said contact projection is fixed to said current-supply conductor at the axial position of said access port with said contact cap biasably seated against said second abutment and said first abutment biasably seated against said pinch seal, securing said contact against said sleeve and said sleeve against said pinch seal.

2. An electric lamp according to claim 1, wherein said access ports in said sleeves are each comprised of two oppositely disposed and aligned bores.

3. An electric lamp according to claim 2, wherein said contact projection is tubular and has an axial bore which receives said current-supply conductor.

4. An electric lamp according to claim 3, wherein each sleeve includes a pair of diametrical slots which snugly receive said pinch seal, said slots having ends which comprise said first abutment.

5. An electric lamp according to claim 4, wherein said second abutment is comprised of a circumferential shoulder inside said sleeve against which said cap of said contact butts against.

6. An electric lamp according to claim 5, wherein each said pinch seal includes a pair of axially extending flanges at opposite lateral sides thereof, said sleeve snugly fitting transversely between said flanges to transversely support said sleeve with respect to said seal.

7. An electric lamp according to claim 1, wherein said contact projection is tubular and has an axial bore which receives said current-supply conductor.

8. An electric lamp according to claim 1, wherein each sleeve includes a pair of diametrical slots which snugly receive said pinch seal, said slots having ends which comprise said first abutment.

9. An electric lamp according to claim 8, wherein each said pinch seal includes a pair of axially extending flanges at opposite lateral sides thereof, said sleeve snugly fitting transversely between said flanges to transversely support said sleeve with respect to said seal.

10. An electric lamp according to claim 8, wherein said second abutment is comprised of a circumferential shoulder inside said sleeve against which said cap of said contact butts against.

11. An electric lamp according to claim 1, wherein said second abutment is comprised of a circumferential shoulder inside said sleeve against which said cap of said contact butts against.

12. An electric lamp according to claim 1, wherein each said pinch seal includes a pair of axially extending flanges at opposite lateral sides thereof, said sleeve snugly fitting transversely between said flanges to transversely support said sleeve with respect to said seal.

* * * * *